US005959509A

United States Patent [19]

Maloratsky et al.

[11] Patent Number: 5,959,509

[45] Date of Patent: Sep. 28, 1999

[54] PRINTED 180 DEGREE DIFFERENTIAL PHASE SHIFTER INCLUDING A NON-UNIFORM NON-REGULAR LINE

[75] Inventors: Leo Maloratsky, Margate; John Ide, Boca Raton, both of Fla.

[73] Assignee: AlliedSignal Inc., Morristown, N.J.

[21] Appl. No.: 08/827,277

[22] Filed: Mar. 27, 1997

Related U.S. Application Data

[63] Continuation of application No. 08/518,448, Aug. 23, 1995, abandoned, which is a continuation-in-part of application No. 08/234,487, Apr. 28, 1994, abandoned.

[51] Int. Cl.[6] ..... H01P 1/18

[52] U.S. Cl. ..... 333/161

[58] Field of Search ..... 333/161, 156, 333/164

[56] References Cited

U.S. PATENT DOCUMENTS 4,612,520 9/1986 Boire et al. ..... 333/164 X 4,616,196 10/1986 Sharma ..... 333/161

5,172,082 12/1992 Livingston et al. ..... 333/161 X

*Primary Examiner*—Benny Lee

[57] ABSTRACT

A printed 180 degree differential phase shifter includes a short nonuniform nonregular line and a uniform transmission line. The nonuniform nonregular line consists of two broadside coupled lines of both sides of a thin dielectric substrate. These highly magnetically coupled lines have short opposite connections (short circuits) connecting the coupled lines with a ground of the uniform line. An opposite input and output of the coupled lines are electrically interconnected with input and output transmission lines having equal impedances. The coupled lines are distant from the ground of the uniform line which can be any transmission line having an electrical length equal to the electrical length of the nonuniform nonregular line.

14 Claims, 3 Drawing Sheets

PRINTED 180 DEGREE DIFFERENTIAL PHASE SHIFTER INCLUDING A NON-UNIFORM NON-REGULAR LINE

CROSS REFERENCE TO RELATED APPLICATIONS

This application is a continuation of U.S. patent application Ser. No. 518,448, filed Aug. 23, 1995, now abandoned, which is a continuation-in-part of U.S. patent application Ser. No. 08/234,487, filed Apr. 28, 1994 by the present inventors now abandoned.

BACKGROUND OF THE INVENTION

The present invention relates to VHF and microwave miniature receivers and transmitters and more particularly to high power amplifiers, modulators, and phase array antennas.

Differential phase shifters are well known in the art. Typical differential phase shifters, however, require diodes, inductors, capacitors, ferrites, Λ/4 couplers and interconnecting cables. These components and their interconnections increase size, cost and line losses while causing a decrease in reliability. It is an object of the present invention to provide a differential phase shifter having no such components and therefore having improved reliability and a reduced size at a reduced cost.

SUMMARY OF THE INVENTION

This invention contemplates a printed 180 degree differential phase shifter including a short nonuniform (coupled) nonregular (without ground plane) line and a uniform (single) transmission line of the same length. The nonuniform, nonregular line consists of two broadside coupled lines on both sides of a thin dielectric substrate without ground metallization in the area of coupled lines. Strong magnetic coupling between the coupled lines provides miniaturization of the phase shifter. The output port of the first coupled line is electrically connected with the opposite end of the second coupled line and with the ground plane of the uniform line.

DETAILED DESCRIPTION OF THE PREFERRED EMBODIMENTS

Figure 1:
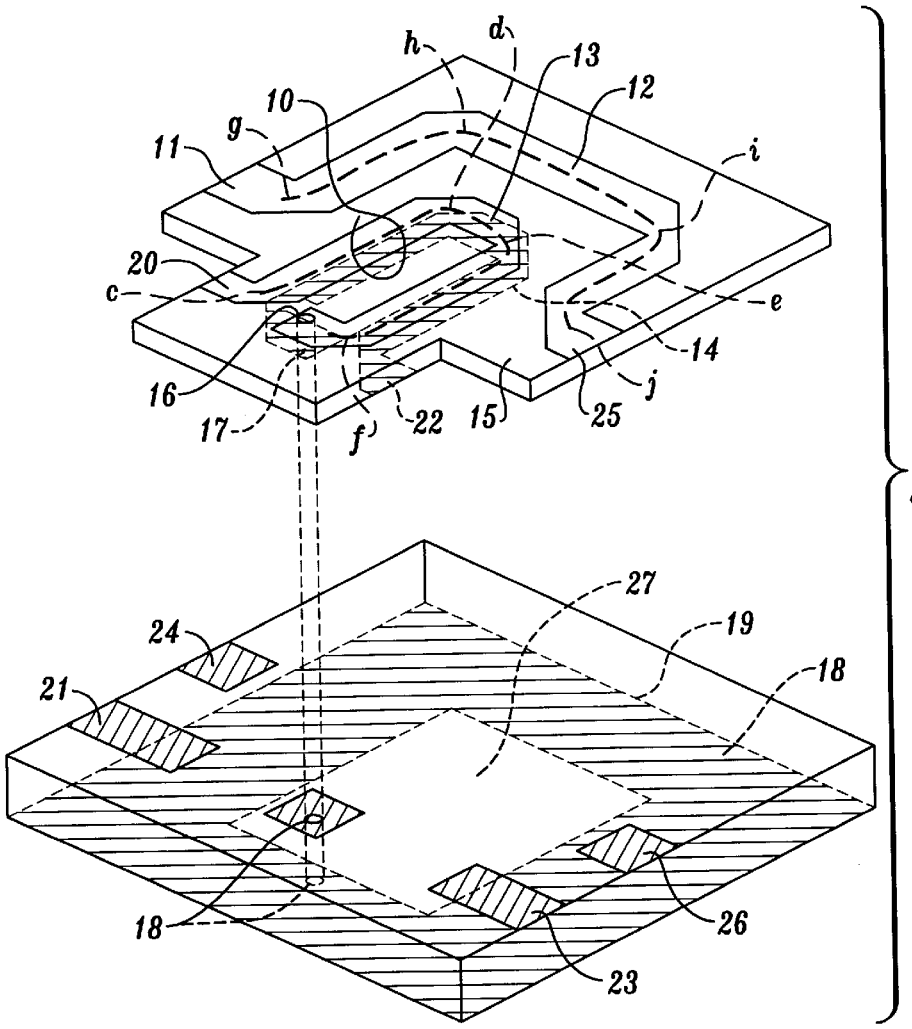
FIG. 1 illustrates an expanded isometric view of one embodiment of the present invention.

Referring to the drawings, FIG. 1 shows the printed 180 degree differential phase shifter of the invention including uniform transmission line 12 and nonuniform nonregular line 10. Nonuniform (coupled) nonregular (without ground plane) line 10 contains two parallel broadside coupled lines 13 (top) and 14 (bottom) located on both sides of a thin dielectric substrate 15. In this invention the coupled lines 13 and 14 have very strong magnetic coupling to provide small length of these lines. Magnetic coupling is determined by the coefficient of magnetic coupling k=M/Lo, where M is mutual inductance per unit of length, Lo is self-inductance per unit of length; 0<k<1. For strong coupling k is in the range of 0.05 to 1.0. In many cases for maximization of k (k approaching 1) iron or ferrite cores are used. However, such materials diminishes thermostability, has high cost and increases the dimensions of the components. In this invention the method of magnetic coupling activization without any cores is used. Strip coupled lines are printed on two sides of the thin dielectric substrate to provide strong magnetic coupling. This effect is intensified by elimination of the ground plane from area 27 directly below the coupled lines. For example, at a thickness equals to of the substrate equals to 0.02" k equals 0.9, and at a thickness equals to 0.002" k equals 0.97. When k grows from 0.85 to 0.99, the length of coupled lines is decreased 10 times.

Coupled lines 13 and 14 have a short circuit connection between end 16 of line 13 and end 17 of line 14. The short circuit connection is connected to ground plane 18 of uniform transmission line 12. Ground plane 18 is located on the base dielectric substrate 19. In FIG. 1 input (or output) port 20 and output (or input) port 22 of the coupled lines are electrically interconnected with corresponding input (or output) port 21 and output (or input) port 23 on base dielectric substrate, 19. Input (or output) port 11 and output (or input) port 25 of uniform line 12 are electrically interconnected with corresponding input (or output) port 24 and output (or input) port 26 on base dielectric substrate 19. Input (output) ports 21, 24 and output (input) ports 23, 26 may be configured for various applications and located on base dielectric substrate 19.

The electrical length of nonuniform nonregular line 10 as shown in FIG. 1 is equal to the electrical length of uniform line 12. The electrical length $\theta_{10}$ of line 10 is equal to $2\pi 1_{10}/\Lambda_{10}$ wherein $\Lambda_{10}$ is equal to the wavelength in line 10 and $1_{10}$ is equal to the geometric length of line 10 which is equal to the line cdef of FIG. 1 which ranges from 0.02 $\Lambda_{10}$ to 0.08 $\Lambda_{10}$. This length depends on the coefficient of magnetic coupling k.

The electrical length $\theta_{12}$ of uniform line 12 is equal to $2\pi 1_{12}/\Lambda_{12}$ wherein $\Lambda_{12}$ is equal to the wavelength in uniform line 12 and $1_{12}$ is equal to the geometric length of uniform line 12 which is equal to line ghij of FIG. 1 which ranges from 0.02 . . . 0.08 $\Lambda_{12}$. In general, wavelengths $\Lambda_{10}$ and $\Lambda_{12}$ are not equal, therefore, for $\theta_{10}=\theta_{12}$ or $2\pi 1_{10}/\Lambda_{10}=2\pi 1_{12}/\Lambda_{12}$ it is necessary that $1_{10}=(\Lambda_{10}/\Lambda_{12})\cdot 1_{12}$.

The length of the nonuniform nonregular line depends on the thickness of dielectric substrate 15. For example, the length of broadside coupled lines on the dielectric with thickness 0.003" is equal to 0.055 $\Lambda_{10}$, and the length of the uniform line is equal to 0.055 $\Lambda_{12}$.

For very short nonuniform nonregular line 10 ($\theta_{10}$<0.01) from Kirchhoff's current rule it follows that the current in input 20 is equal and opposite in direction, whereby the current in output 22, i.e. the phase shift in said line 10 is 180 degrees. For short nonuniform nonregular line 10 ($\theta_{10}$>0.01) the 180 degree phase shift is obtained as a result of subtraction of the uniform line phase response. The concept of the invention and its implementation can be achieved in different ways. For example, a configuration of the compact printed nonuniform nonregular line and the uniform line can be realized by a meander line, a spiral line, etc. The uniform line can be based on any planar transmission line (microstrip, stripline, etc.).

Considering the arrangement shown in FIG. 1, VHF or microwave signals are applied to port 24 of the uniform line and port 21 of nonuniform nonregular line 10. These signals pass through the differential phase shifter and appear at ports 26 and 23, respectively, having differentional phase 180 degrees: the signal in port 23 has the lagging phase in comparison with the phase of the signal in port 26.

Similarly, if ports 26 and 23 are properly terminated and input signals are applied to these ports, the resulting signals at ports 24 and 21, respectively, have differential phase shift 180 degrees: the signal in port 21 has the lagging phase in comparison with the phase of the signal in port 24.

Figure 2:
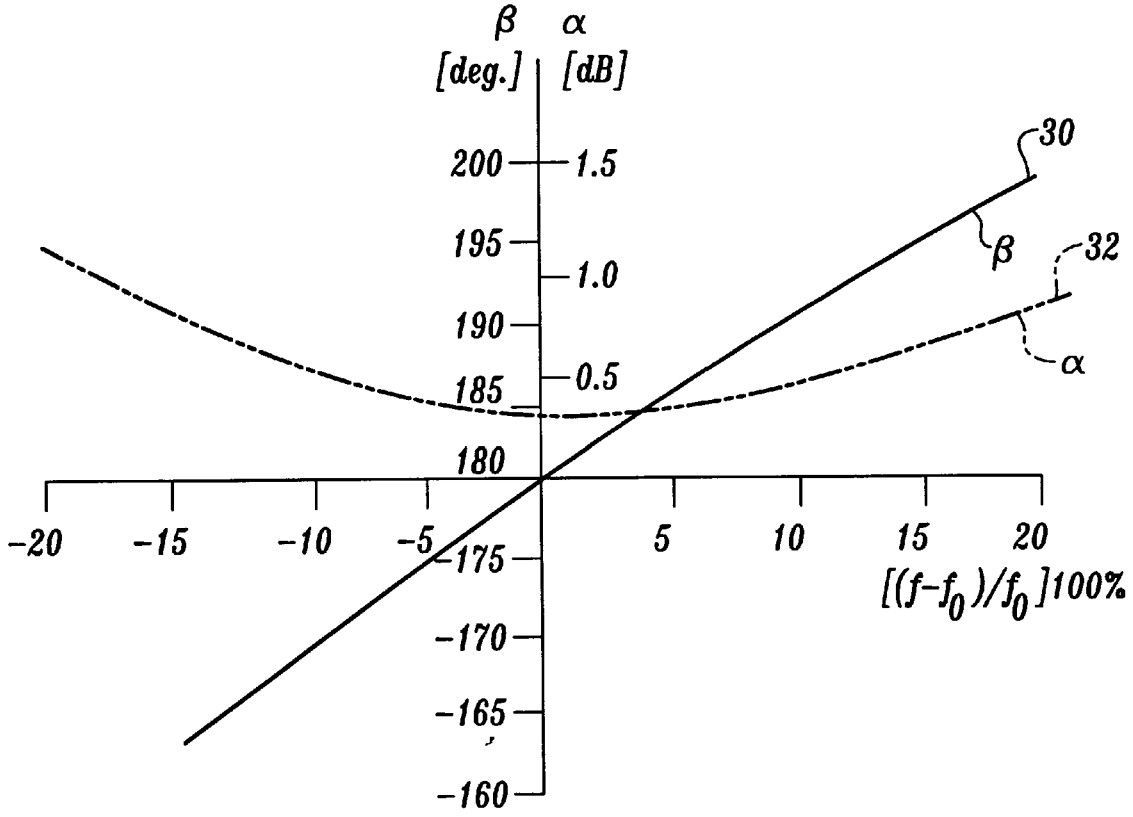
FIG. 2 illustrates dependence of phase shift (in degrees) and loss (in dB) on relative detuning (in percent) for a thin dielectric with a thickness of 0.003" and a length of coupled lines of 0.055".

The uniform line of variable length can be used for adjustment of a phase shift. FIG. 2 shows dependence of a phase shift 30 (in degrees) and loss 32 (in dB) on relative detuning (in percent) for a thin "Kapton" dielectric with thickness 0.003" and a length of coupled lines $1_{10}=0.055\ \Lambda_{10}$ which is mapped on the horizontal axis. The uniform microstrip line is printed on the same "Kapton" substrate which is connected with base dielectric substrate made of "Duroid 5880". It can be seen that this gives a phase shift equal to 180 degrees±5 degrees and losses that are less than 0.3 dB for a relative detuning of±5 percent (center frequency equals 120 MHz). Other phase shift accuracies, losses and bandwidth performance combinations can be obtained by appropriate selection of the thickness of the thin dielectric substrate and the length of coupled lines.

Figure 3:
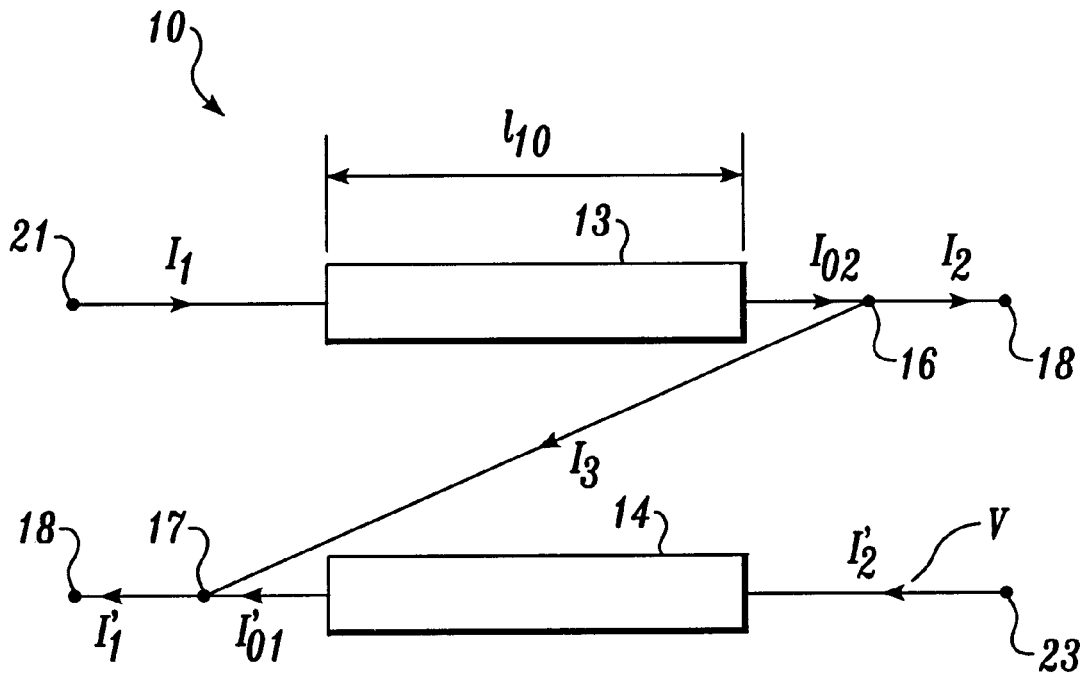
FIG. 3 is a diagrammatic representation illustrating the implementation of the 180 degree phase shift.

With the above in mind it will be understood that nonuniform nonregular line 10 with ports 21 and 23 assigned as input and output transmission lines is equivalent to a two-port network (FIG. 3). The notation is kept the same as in FIG. 1. From Kirchhoff's current rule it follows (FIG. 3) that if the currents at port 21 and ground plane 18 of the two-port network are equal and opposite in direction, then the current at port 23 and ground plane 18 are likewise equal and opposite in direction.

$$\text{If } I=-I_1' \text{ then } I_2=-I'_2. \tag{1}$$

Currents in top and bottom coupled lines 13, 14 of the very short $$\left(\theta_{10}=\frac{2\pi l_{10}}{\Lambda_{10}}<0.01\right)$$

nonuniform nonregular line 10 are determined by:

$$I_{02}=-I_{01}. \tag{2}$$

From Kirchhoff's current rule (FIG. 3) it follows that:

$$I_{02}=I_2+I_3$$

$$I_{01}+I_3=I_1'. \tag{3}$$

$I_1$=current at input 21;

$I_1'$=current from end 17 to ground plane 18;

$I_{01}'$=current of line 14;

$I_2$=current from end 16 to ground plane 18;

$I_2'$=current at output 23;

$I_{02}$=current of line 13.

Applying equations (1) and (2) to equations (3) it is seen that $I_1=-I'_2$. Thus, the phase shift in the given nonuniform nonregular line is 180 degrees.

It is not intended that this invention be limited to the hardware arrangement or operational procedures shown disclosed. This invention includes all of the alterations and variations thereto as encompassed within the scope of the claims as follows.

What is claimed is:

1. A printed 180 degree differential phase shifter comprising:

a thin dielectric substrate mounted to a base;

a uniform transmission line mounted on said dielectric substrate, said uniform transmission line comprising an input and an output;

a nonuniform nonregular line mounted on said thin dielectric substrate, said nonuniform nonregular line comprising:

an input;

an output; and two parallel broadside coupled lines mounted on each side of said thin dielectric substrate, wherein said parallel broadside coupled lines have a substantially constant width along an entire length thereof; and a ground is mounted on said base for the uniform transmission line;

wherein said uniform transmission line and said nonuniform nonregular line have equal electrical length which depends on thickness of said thin dielectric substrate.

2. A printed 180 degree differential phase shifter as claimed in claim 1, wherein said nonuniform nonregular line and said uniform transmission line have equal input and output impedances.

3. A printed 180 degree differential phase shifter as claimed in claim 1, wherein said two parallel broadside coupled lines mounted on each side of said thin dielectric substrate have high magnetic coupling.

4. A printed 180 degree differential phase shifter as claimed in claim 3 wherein each of said two parallel broadside coupled lines mounted on each side of said thin dielectric substrate comprise short circuit connections.

5. A printed 180 degree differential phase shifter as claimed in claim 4 wherein said short circuit connections connect each of said two parallel broadside coupled lines to said ground on said base.

6. A printed 180 degree differential phase shifter as claimed in claim 1, further comprising a short circuit connection between opposite ends of each of said two parallel coupled lines and said ground of said uniform transmission line.

7. A printed 180 degree differential phase shifter comprising:

thin dielectric substrate means mounted to a base;

uniform transmission line means mounted on said thin dielectric substrate means comprising an input and an output;

nonuniform nonregular line means mounted on said thin dielectric substrate means, wherein said nonuniform line means comprises two parallel broadside coupled lines mounted on each side of said thin dielectric substrate, said nonuniform nonregular line means comprising:

an input;

an output; and a short circuit connection between opposite ends of each of said two parallel broadside coupled lines and a ground of said uniform transmission line means;

wherein said uniform transmission line means and said nonuniform nonregular line means have equal electrical length dependent on thickness of said thin dielectric substrate means.

8. A printed 180 degree differential phase shifter comprising:

thin dielectric substrate means mounted to a base;

uniform transmission line means mounted on said thin dielectric substrate means comprising an input and an output;

nonuniform nonregular line means mounted on said thin dielectric substrate means comprising an input and an output wherein said nonuniform line means comprises two parallel broadside coupled lines mounted on each side of said thin dielectric substrate, wherein said parallel broadside coupled lines have a substantially constant width along an entire length thereof;

wherein said uniform transmission line means and said nonuniform nonregular line means have equal electrical length dependent on thickness of said thin dielectric substrate means.

9. A printed 180 degree differential phase shifter as claimed in claim 8 further comprising two short circuits connecting opposite ends of each of said two parallel broadside coupled lines with a ground of said uniform line means.

10. A printed 180 degree differential phase shifter comprising:

a thin dielectric substrate mounted to a base;

a uniform transmission line mounted on said dielectric substrate, said uniform transmission line comprising an input and an output;

a nonuniform nonregular line mounted on said thin dielectric substrate, said nonuniform nonregular line comprising:

an input;

an output; and two parallel broadside coupled lines mounted on each side of said thin dielectric substrate, wherein said two parallel broadside coupled lines have high magnetic coupling; and a ground is mounted on said base for the uniform transmission line;

wherein said uniform transmission line and said nonuniform nonregular line have equal electrical length which depends on thickness of said thin dielectric substrate.

11. A printed 180 degree differential phase shifter as claimed in claim 10, further comprising a short circuit between opposite ends of each of said two parallel coupled lines and said ground.

12. A printed 180 degree differential phase shift as claimed in claim 10, wherein said nonuniform nonregular line and said uniform transmission line have equal input and output impedances.

13. A printed 180 degree differential phase shifter as claimed in claim 10, wherein each of said two parallel broadside coupled lines comprise short circuit connections.

14. A printed 180 degree differential phase shifter as claimed in claim 13, wherein said short circuit connections connect each of said two parallel broadside coupled lines to said ground.

* * * * *